United States Patent [19]

Tamagawa et al.

[11] Patent Number: 4,678,742

[45] Date of Patent: Jul. 7, 1987

[54] PHOTOGRAPHIC PRINTING PAPER SUPPORT

[75] Inventors: Shigehisa Tamagawa; Tetsuro Fuchizawa; Hisamasa Abe, all of Shizuoka, Japan

[73] Assignee: Fuji Photo Film Co., Ltd., Kanagawa, Japan

[21] Appl. No.: 733,331

[22] Filed: May 13, 1985

[30] Foreign Application Priority Data

May 11, 1984 [JP] Japan ..... 59-95267

[51] Int. Cl.[4] ..... G03C 1/76

[52] U.S. Cl. ..... 430/523; 428/211; 428/323; 428/331; 428/513; 428/516; 428/520; 428/522; 428/537.5; 430/537; 430/538; 430/950

[58] Field of Search ..... 430/538, 950, 537, 523; 428/211, 516, 520, 537.5, 513, 522, 323, 331

[56] References Cited

U.S. PATENT DOCUMENTS

| | | | |
|---|---|---|---|
| 3,161,519 | 12/1964 | Alsup | 430/950 |
| 3,671,248 | 6/1972 | Eldridge et al. | 430/538 |
| 4,100,329 | 6/1978 | Neithardt, Jr. | 430/950 |
| 4,312,937 | 1/1982 | Kasper et al. | 430/538 |

*Primary Examiner*—George F. Lesmes
*Assistant Examiner*—P. R. Schwartz
*Attorney, Agent, or Firm*—Sughrue, Mion, Zinn, Macpeak and Seas

[57] ABSTRACT

A photographic printing paper support is described, comprising a base paper having a polyolefin layer formed on both surfaces thereof, said support having provided on a back surface thereof a writing property providing layer composed of (a) inorganic pigment having an average particle diameter from 0.1 to 2.0 μm and oil absorption degree of 100 cc/100 g or less, and (b) an acrylic emulsion having a glass transition point of from 20° C. to 50° C.

5 Claims, No Drawings

PHOTOGRAPHIC PRINTING PAPER SUPPORT

FIELD OF THE INVENTION

The present invention relates to a photographic printing paper support coated with polyolefin, particularly to a support for photographic printing paper which is superior for writing on the back surface thereof, and more particularly to a support for photographic printing paper which does not adhere to a front surface (surface to which photographic emulsions are applied), and which has a back surface having excellent writing properties thereon without exhibiting staining during a developing treatment.

BACKGROUND OF THE INVENTION

Baryta paper has been conventionally used for photographic printing paper. However, after so-called water-resistant printing paper coated with polyolefin on both surfaces of base paper was invented for the purpose of allowing more rapidity in the developing treatment, such printing paper has become the predominant type of water-resistant photographic printing paper. Usually, such water-resistant printing paper has a photographic emulsion layer on one surface thereof (generally a polyolefin layer containing an inorganic pigment such as titanium oxide, $TiO_2$).

It is desirable that the other surface to which an emulsion layer is not applied, that is, the back surface, has good properties for purposes of being subject to writing, drawing, and printing thereon for various purposes, by using a ball-point pen, a fountain pen, a pencil, with oil-based ink, water-based ink, or the like.

However, as described above, the water-resistant printing paper is coated with polyolefin, most popularly polyethylene. The surface of this paper is therefore hydrophobic and non-absorbent, and this paper is disadvantages, for example, in that it is difficult to write thereon with a pencil or fountain pen, in that the paper is apt to be damaged by writing thereon, and in that the record is apt to disappear or blot by slight rubbing after writing.

As a method for providing improved properties with respect to writing, drawing, printing, or the like, on a polyolefin layer, conventionally, there have been proposed, for example, a method of roughening the surface with sandblasting, embossing, or the like, or a method of roughening the surface by etching with acid, or the like. However, a polyolefin layer treated by such a method has no satisfactory property in writing.

In order to overcome these disadvantages, various methods have been proposed, e.g., as follows:

(1) A method of incorporating an inorganic pigment having an average diameter of from 1 to 40 μm into a polyolefin resin layer on the back surface, as described in Japanese Patent Application (OPI) No. 43528/1980 (The term "OPI" as used herein refers to a "published unexamined Japanese patent application");

(2) A method of providing a layer consisting of a water-soluble polymer, such as polyvinyl alcohol and carboxyl methyl cellulose, and water silica sol, as described in Japanese Patent Publication No. 14884/1969;

(3) A method of providing a layer consisting of a water-insoluble polymer emulsion, such as a polyethylene emulsion, and water silica sol, as described in Japanese Patent Publication No. 36565/1975; and (4) A method of providing a coating layer including a pigment such as clay, and having a hygroscopic quality, as described in Japanese Utility Model Application Laid-Open No. 169426/1977.

However, each of these known methods has defects. For example, the method of incorporating from 1 to 40 μm inorganic pigment into a polyolefin resin layer of a back surface is of little practical use, because of problems such as a poor quality due to breaking of the resin layer, staining pigment during the manufacturing process, etc. For the layer applied with the conventional compound, it is necessary to select the amount of application to be about 5 g/m$^2$, or in some cases, 10 g/m$^2$ or more, in order to provide good writing properties, particularly with respect to pencil writing. Therefore, the preparation of such coated layers has been restricted in many respects, for example, in regard to the drying step, etc.

With respect to defects in quality, disadvantages such as disjoining or elution of the applied layer, coloring in the applied layer by developing solutions, adhering of the coating layer with the surface, etc., occur, and no product fully satisfying the desired properties has no far been obtained.

SUMMARY OF THE INVENTION

It is therefore an object of the present invention to solve the above-described problems in the prior art.

Another object of the present invention is to provide a photographic printing paper support in which the amount of material applied onto a polyolefin layer on a back surface is minimized, to efficiently provide a property of facilitating writing thereon, and in which elution, disjoining, and coloring can be prevented from occurring in the applied writing layer during or after developing.

A further object of the present invention is to provide a photographic printing paper support in which adhering can not occur with the front surface (the term "the front surface" as used herein means a surface to which a photographic emulsion is applied, and usually, an undercoating layer containing gelatin as a main component is provided on the front surface so as to improve joining between the emulsion and the front surface of the photographic printing paper).

As a result of extensive research to overcome the above-described defects in the prior art, the present inventors have achieved the above-mentioned objects, and thus, according to the present invention, a photographic printing paper support is provided, comprising a base paper having each of its opposite surfaces coated with a polyolefin layer, and a writing property providing layer provided on one of said opposite surfaces containing (a) inorganic pigment having an average particle diameter of from 0.1 to 2.0 μm and having an oil absorption degree of 100 cc/100 g or less, and (b) an acrylic emulsion having a glass transition point (hereinafter abbreviated as "Tg") of from 20° to 50° C.

DETAILED DESCRIPTION OF THE INVENTION

The photographic printing paper support according to the present invention is composed of base paper, polyolefin resin layers applied on both surfaces of the base paper, and a layer provided on one surface the polyolefin resin layer, particularly the back surface, in order to facilitate writing. The base paper used for the photographic printing paper support according to the present invention may be suitably selected from generally available materials used as photographic printing paper, For instance, such base paper can be made from natural pulp derived from cniferous or deciduous trees as a main material, and, if desired, various agents, such as a sizing agent, a paper reinforcing agent, a filler, a fixing agent, etc., are added to the main material as additional materials. Usually, a base paper having a thickness of from 50 to 300 μm is used.

Examples of the polyolefin resin composition forming the polyolefin resin coating layer of the photographic printing paper support according to the present invention include a homopolymer or a copolymer of α-olefin such as polyethylene, polypropylene, etc. Especially preferably used is a high density polyethylene, a low density polyethylene, or a mixture thereof. The thickness of the resin layer is usually selected to be from 15 to 50 μm. Further, if necessary, pigment, a fluorescent whitening agent, an antioxidant agent, etc., are added into the resin layer.

The inorganic pigment used in the writing property providing layer according to the present invention contains inorganic pigment having an average particle diameter of from 0.1 to 2.0 μm, preferably from 0.3 to 1.0 μm, and an oil absorption degree of 100 cc/100 g or less, preferably 80 to 30 cc/100 g. The preferred examples of the inorganic pigment include a crystalline silica, a synthetic alumina-silica, an amorphous silica, a barium sulfate, an aluminum hydroxide, a talc, a kaolin, etc. For providing a pencil writing property, a crystalline silica or a synthetic alumina-silica is preferably used. If the particle diameter is smaller than 0.1 μm, the writing property decreases sharply, especially in the case where a pencil is used. On the contrary, if the particle diameter is larger than 2.0 μm, there are disadvantages that roughness occurs on the paper surface although there is a writing property, and that the pigment may separate from the applied writing layer during or after the developing processing of the printing paper. Further, if the oil absorption degree is selected above 100 cc/100 g, there is a disadvantage in that blotting with oil-based ink increases.

The acrylic emulsion according to the present invention is an emulsion prepared using as a monomer component an acrylic ester, e.g., methyl acrylate, ethyl acrylate, butyl acrylate, 2-ethylhexyl acrylate, etc. For example, a copolymer of an acrylic ester and the other monomers, e.g., etyrene and/or methylmethacrylate (hereinafter abbreviated as "MMA") is preferred, and more preferably a copolymer of these three components.

By changing the ratio of the monomer components and the kinds of the acrylic esters, an acrylic emulsion having a desired Tg can be obtained. If the Tg of acrylic emulsion is lower than 20° C., there is a tendency of occurrence of a problem of adhering to the front surface. If the Tg is larger than 50° C., on the other hand, there occurs a problem of increased coloring during developing.

As used herein, the expression "glass transition point" (Tg) is defined as a measured value obtained through a TMA method (thermomechanical analysis) by using an apparatus of Perkin Elmer Corporation.

As the acrylic ester to be used, methyl acrylate, ethyl acrylate, butyl acrylate, hydroxypropyl acrylate, 2-hydroxyethyl acrylate, 2-ethylhexyl acrylate, and so forth, are preferable.

The weight ratio of the inorganic pigment and the binder (acrylic emulsion) is preferably selected to fall within a range from 3/1 to $\frac{1}{3}$. If the ratio is out of this range, there arises undesirable problems of reduction in writing property, an adhering tendency between the writing layer and the polyolefin layer, etc.

Further, in order to improve the film hardness of the writing layer on the back surface, it is preferable to use an active halogenide hardening agent, such as 2,4-dichloro-6-hydroxy-s-triazine sodium, 2,4-dichloro-6-methoxy-s-triazine, 2,4-dichloro-6-(2-sulfoethylamino)-s-triazine, or N-N'-bis(2-chloroethylcarbamyl)piperazine.

Furthermore, in order to improve the mechanical stability of the emulsion, it is preferable to add a polymeric protective colloid, such as, for example, PVA (polyvinyl alcohol), CMC (carboxymethyl cellulose), methylcellulose, etc.

The liquid to be used for forming the writing layer as described above onto the polyolefin layer is of an aqueous type, and, if desired, a solvent such as methanol, ethanol, or the like, may be added thereto.

The application of the applied writing layer may be performed by a known method, such as a dip coating method, an air knife coating method, a curtain coating method, a roller coating method, a doctor coating method, a wire bar coating method, a slide coating method, a gravure coating method, or by any other appropriate method. For detailed description, refer to *Coating Kogaku* (*Coating Technology*), pages 253–277 (1971, from Asakura Shoten, Tokyo).

It is desireable to perform a surface activation treatment on the surface of the polyolefin layer through a known method before forming the applied writing layer. For the surface activation treatment, used are an etching treatment with acid, a flaming treatment by means of a gas burner, a corona discharging treatment, a glow discharging treatment, etc.

Although there is no particular limit in thickness of the writing property providing layer, the object of the invention is not particularly limited, the object of the present invention can be achieved by selecting the thickness to be 0.1 to 3 μm.

Examples of the present invention are described hereunder, but the present invention is in no way limited by these examples. Unless otherwise indicated, all parts, percents, ratio and the like are by weight.

EXAMPLE 1

Sodium stearate was added in an amount of 1.0 wt% to wood pulp (based on absolute dry pulp weight) beaten to a degree of 300 cc Canadian freeness (LBKP), and then aluminium sulfate, polyamide-polyamine-epichlorhydrine (trademark KYMEN 557 of Dick Hercules Corporation), and alkylketene dimer (trademark AQUAPEL of Dick Hercules Corporation) were added by 1.5 wt%, 0.5 wt%, and 0.3 wt%, respectively, again based on the absolute dry pulp weight, whereby paper was prepared in a conventional manner such that the coating amount (basis weight) was 150 g/m$^2$. Next, after calcium chloride was adhered at 1 wt% (based on the paper weight) onto the base paper by surface sizing and dried, the thickness of the paper was adjusted by calender to be 160 μm. The back surface of this base paper was coated with polyethylene of a density of about 0.930 g/cm$^3$ at a thickness of about 0.33 mm, and the front surface was coated with polyethylene of a density of about 0.960 g/cm$^3$ containing titanium oxide of 10% by weight at a thickness of about 0.30 mm, thereby obtaining a support for a photographic printing paper.

On the back surface of the thus obtained support, a writing layer-forming liquid of the components as described in Tables 1 and 2 was applied by a wire bar coating method at 20 cc per 1 $m^2$.

Next, gelatin as an undercoating was applied onto the front surface in an amount of about 0.1 $g/m^2$, thereby obtaining a photographic printing paper support.

With respect to the supports for photographic printing paper (No. 1 to No. 4: examples according to this invention; No. 5 to No. 8: comparable examples), evaluation was effected as to a writing property (feeling in writing with a pencil and blotting with an oil-based ink), an adhering tendency (adhering with the undercoating on the front surface*), and coloring during developing (difference in degree of whiteness between before and after development treatment**).

"*": The state of adhering after three days leaving at 50° C. and 90% RH. "**": Measured by means of Hunter whiteness meter (JIS-P-8123).

The results shown in Table 3 indicates that the support for photographic printing paper according to the present invention has a high quality with respect to all properties as described above.

TABLE 1

(The present invention)

| Sample No. | | |
|---|---|---|
| No. 1 | Tg 25° C. acrylic emulsion (MMA/styrene/acrylic ester) | 4.0 part |
| | Crystalline sillica of average particle diameter 0.5 μm and of oil absorption degree 70 cc/100 g | 2.0 part |
| | PVA | 0.1 part |
| | 2,4-dichloro-6-hydroxy-s-triazine sodium | 0.1 part |
| | Water | 93.8 part |
| No. 2 | Tg 25° C. acrylic emulsion (MMA/styrene/acrylic ester) | 4.0 part |
| | Alumina silica of average particle diameter 1.0 μm and of oil absorption degree 50 cc/100 g | 2.0 part |
| | PAV | 0.1 part |
| | 2,4-dichloro-6-hydroxy-s-triazine sodium | 0.1 part |
| | Water | 93.8 part |
| No. 3 | Tg 35° C. acrylic emulsion (MMA/Styrene/acrylic ester) | 3.0 part |
| | Crystalline silica of average particle diameter 0.3 μm and of oil absorption degree 70 cc/100 g | 3.0 part |
| | PAV | 0.1 part |
| | 2,4-dichloro-6-hydroxy-s-triazine sodium | 0.1 part |
| | Water | 93.8 part |
| No. 4 | Tg 35° C. acrylic emulsion (MMA/styrene/acrylic ester) | 3.0 part |
| | Alumina sillica of average particle diameter 1.0 μm and of oil absorption degree 50 cc/100 g | 3.0 part |
| | PAV | 0.1 part |
| | 2,4-dichloro-6-hydroxy-s-triazine sodium | 0.1 part |
| | Ethanol | 20.0 part |
| | Water | 73.8 part |

TABLE 2

(Comparative Examples)

| Sample No. | Composition of Applied Liquid | |
|---|---|---|
| No. 5 | Tg 10° C. SBR latex | 4.0 part |
| | Crystalline silica of average particle diameter 0.5 μm and of oil absorption degree 70 cc/100 g | 2.0 part |
| | 2,4-dichloro-6-hydroxy-s-triazine sodium | 0.1 part |
| | Water | 93.9 part |
| No. 6 | Tg 5° C. acrylic emulsion (styrene/acrylic ester) | 4.0 part |
| | Crystalline silica of average particle diameter 0.5 μm and of oil absorption degree 70 cc/100 g | 2.0 part |
| | PVA | 0.1 part |
| | 2,4-dichloro-6-hydroxy-s-triazine sodium | 0.1 part |
| | Water | 93.8 part |
| | Tg 70° C. acrylic emulsion (MMA/acrylic ester) | 4.0 part |
| | Alumina silica of average particle diameter 1.0 μm and of oil absorption degree 50 cc/100 g | 2.0 part |
| No. 7 | PAV | 0.1 part |
| | 2,4-dichloro-6-hydroxy-s-triazine sodium | 0.1 part |
| | Water | 93.8 part |
| | Tg 70° C. acrylic emulsion (MMA/acrylic ester) | 4.0 part |
| | Synthetic silica of average particle diameter 5.0 μm and of oil absorption degree 300 cc/100 g | 2.0 part |
| No. 8 | 2,4-dichloro-6-hydroxy-s-triazine sodium | 0.1 part |
| | Water | 93.9 part |

TABLE 3

| Sample No. | Writing | Adhering | Coloring |
|---|---|---|---|
| No. 1 | good | good | 0.2% |
| No. 2 | good | good | 0.1% |
| No. 3 | good | good | 0.3% |
| No. 4 | good | good | 0.2% |
| No. 5 | good | bad (adhered with surface) | 0.2% |
| No. 6 | good | bad (adhered with surface) | 0.1% |
| No. 7 | good | good | 2.2% |
| No. 8 | bad (pencil writing feeling) (ink blotting) | good | 2.4% |

While the invention has been described in detail and with reference to specific embodiments thereof, it will be apparent to one skilled in the art that various changes and modifications can be made therein without departing from the spirit and scope thereof.

What is claimed is:

1. A photographic printing paper support comprising a base paper having a polyolefin layer formed on both surfaces thereof, said support having coated on the polyolefin layer on the back surface thereof a writing property providing layer composed of (a) inorganic pigment having an average particle diameter of from 0.1 to 2.0 μm and an oil absorption degree of 100 cc/100 g or less, and (b) an acrylic emulsion having a glass transition point of from 20° C. to 50° C., wherein the acrylic emulsion is composed of a copolymer of an acrylic ester and at least one monomer selected from styrene and methyl methacrylate and wherein said support has a photographic emulsion coated on the surface thereof opposite the back surface.

2. A photographic printing paper support as in claim 1, wherein the acrylic emulsion is an emulsion prepared using the acrylic ester selected from methyl acrylate, ethyl acrylate, butyl acrylate, or 2-ethylhexyl acrylate.

3. A photographic printing paper support as in claim 1, wherein the acrylic emulsion is composed of a three-component copolymer consisting of methylmethcrylate, styrene, and acrylic ester.

4. A photographic printing paper support as in claim 1, wherein the inorganic pigment has an average particle diameter of from 0.3 to 1.0 μm.

5. A photographic printing paper support as in claim 1, wherein the inorganic pigment is selected from a crystalline silica, a synthetic alumina-silica, an amorphous silica, a barium sulfate, an aluminum hydroxide, a talc, or a kaolin.

* * * * *